US006707016B2

(12) United States Patent
Sundberg

(10) Patent No.: US 6,707,016 B2
(45) Date of Patent: Mar. 16, 2004

(54) METHOD OF INCREASING THE LENGTH OF LIFE OF HEATING ELEMENTS AT LOW TEMPERATURES

(75) Inventor: Mats Sundberg, Västerås (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 10/275,168

(22) PCT Filed: May 16, 2001

(86) PCT No.: PCT/SE01/01081

§ 371 (c)(1),
(2), (4) Date: Nov. 2, 2002

(87) PCT Pub. No.: WO01/89266

PCT Pub. Date: Nov. 22, 2001

(65) Prior Publication Data

US 2003/0150851 A1 Aug. 14, 2003

(30) Foreign Application Priority Data

May 18, 2000 (SE) ..... 0001846

(51) Int. Cl.[7] ..... H05B 3/10

(52) U.S. Cl. ..... 219/548; 219/553; 219/549; 338/22 R

(58) Field of Search ..... 219/528, 549, 219/505, 213, 548, 553; 392/435; 338/22 R

(56) References Cited

U.S. PATENT DOCUMENTS

| | | | | | |
|---|---|---|---|---|---|
| 5,708,408 | A | * | 1/1998 | Sundberg | 338/306 |
| 6,008,479 | A | | 12/1999 | Jiang et al. | 219/553 |
| 6,143,206 | A | * | 11/2000 | Handa et al. | 252/500 |
| 6,211,496 | B1 | * | 4/2001 | Uchiyama et al. | 219/548 |
| 6,482,759 | B1 | * | 11/2002 | Sundberg et al. | 501/96.3 |
| 6,563,095 | B1 | * | 5/2003 | Sundberg | 219/553 |

FOREIGN PATENT DOCUMENTS

| | | |
|---|---|---|
| EP | 0 886 458 A2 | 12/1998 |
| WO | WO96/32358 | 10/1996 |

* cited by examiner

*Primary Examiner*—Edward K. Look
*Assistant Examiner*—Vinod D. Patel
(74) *Attorney, Agent, or Firm*—Alfred J. Mangels

(57) ABSTRACT

A method of lengthening the useful life of heating elements that are formed essentially from molybdenum silicide and molybdenum tungsten silicide and different alloys of those basic materials, at times when the elements are operated at a relatively low temperature, such as a temperature in the range of 400–800° C. The gaseous atmosphere surrounding the elements as they operate has a water content that is less than about one percent by volume.

3 Claims, 1 Drawing Sheet

METHOD OF INCREASING THE LENGTH OF LIFE OF HEATING ELEMENTS AT LOW TEMPERATURES

BACKGROUND OF THE INVENTION

1. Field of the Invention

The present invention relates to method of lengthening the useful life of heating elements at low temperatures. More specifically, the useful life of heating elements that include molybdenum silicide and molybdenum tungsten silicide, as well as different alloys of these basic materials, is lengthened. Such heating elements are produced by Applicant Sandvik AB in a relatively large number of applications.

2. Description of the Related Art

When such heating elements are operated at relatively low temperatures, for example at temperatures around 400–500° C., no protective silica scale (so-called glass layer) will form on the elements, as opposed to when operating the elements at high temperatures. Instead, the elements are subjected to so-called pest, meaning that a non-protective layer of $MoO_3$ and $SiO_2$ forms on the surfaces of the elements. This mixture is porous and readily disintegrates, resulting in a significant shortening of the useful life of the elements.

However, there are applications in which such elements are, nevertheless, the best alternative. One example in this regard is found in the heating of LPCVD-chambers, (Low pressure Chemical Vapor Deposition) in the manufacture of electronic circuits.

The low temperature properties of such heating elements can be improved, by pre-oxidizing the elements at a temperature of about 1500° C. or higher, so as to form a skin of $SiO_2$. Such a skin will slow down the formation of pest.

The proposed method greatly lengthens the useful life of such heating elements.

SUMMARY OF THE INVENTION

The present invention thus relates to a method of lengthening the useful life of heating elements that are essentially formed from molybdenum silicide and molybdenum tungsten silicide and different alloys of these basic materials, when said elements are operated at a low temperature, such as a temperature in the range of 400–800° C. The method includes providing a gaseous atmosphere that surrounds the elements when said elements are operated, wherein the gaseous atmosphere has a water content that is less than about one percent by volume.

The present invention is based on the surprising insight that the oxide products $MoO_3$ and $SiO_2$ are formed to a much less extent when the water content of the gas surrounding the elements is kept to a low level, despite the oxygen content of the surrounding gaseous atmosphere being very high.

BRIEF DESCRIPTION OF THE DRAWINGS

The invention will now be described in more detail with reference to the accompanying drawing, in which.

DESCRIPTION OF THE PREFERRED EMBODIMENTS

The present invention relates to a method of lengthening the useful life of heating elements that are essentially comprised of molybdenum silicide and molybdenum tungsten silicide and different alloys of these basic materials when the elements are operated at a relatively low temperature, such as a temperature in the range of 400–800° C. It is at this temperature range that such elements are subjected to so-called pest. The temperature at which the elements are operated varies in accordance with the process in which the elements are used on the one hand, and in accordance with the composition of the material from which the elements are made on the other hand.

Pest is the formation of $MoO_3$ and $SiO_2$ from $MoSi_2$ and $O_2$. This oxide mixture is relatively porous and does not therefore afford any protection against continued oxidation.

According to the invention, the atmosphere surrounding the elements as they operate is caused to have a water vapor content of less than about one percent by volume. This results in a marked decrease in the growth of pest.

Figure 1:
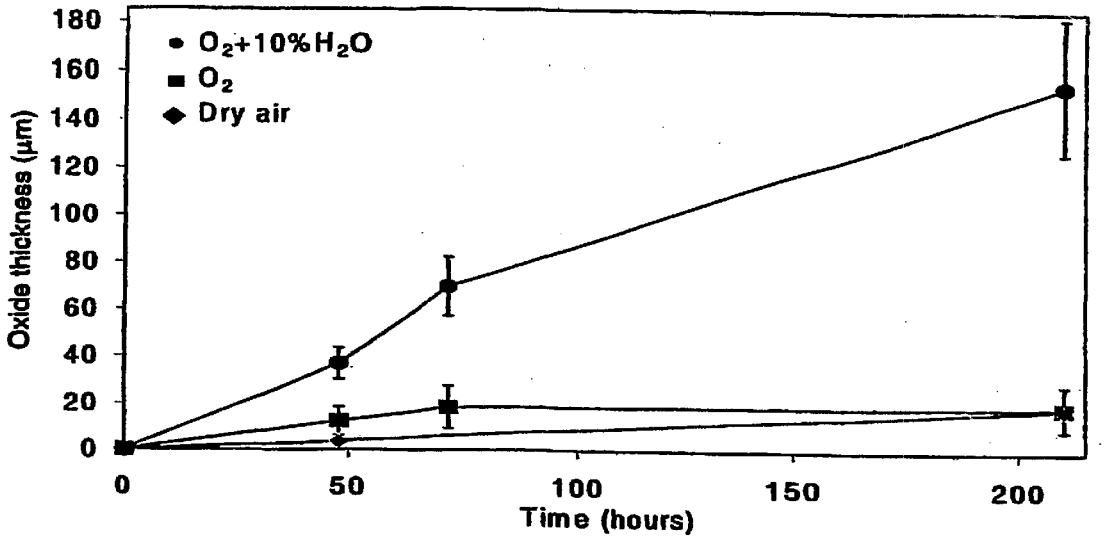
FIG. 1 is a graph that shows oxide thickness as a function of time for different gases.

FIG. 1 shows the oxide thickness of $MoO_3$ and $SiO_2$ in different gaseous atmospheres at 450° C. By dry air in FIG. 1 is meant that the air has a water content of 0.0005 percent by volume. The oxygen gas ($O_2$) is correspondingly dry. By $O_2$+10% $H_2O$ is meant oxygen gas with a water content of 10 percent by volume.

It will be evident from FIG. 1 that the oxide thickness increase over time has been greatly limited and is essentially the same for both dry air and dry oxygen gas, whereas the rate of thickness increase is more than ten times faster when the surrounding atmosphere contains ten percent by volume water.

Figure 2:
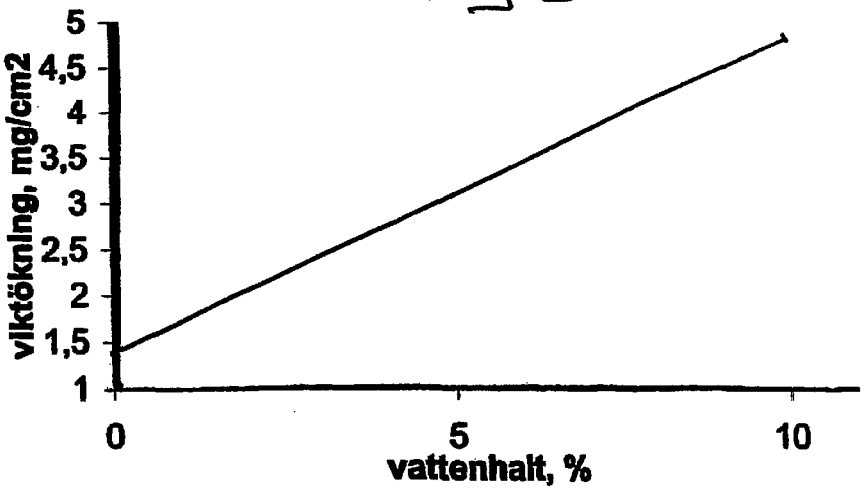
FIG. 2 is a graph that shows the increase in weight caused by oxidation as a function of the water content of the surrounding gas.

FIG. 2 shows the weight increase of a material caused by the formation of said oxides as a function of the water content in percent by volume of the atmosphere surrounding the heating elements at an element temperature of 450° C.

As will be evident from FIG. 2, the oxidation, the pest formation, increases linearly with the water content.

It has been established that different oxide structures are formed at different water contents of the surrounding atmosphere.

An oxide consisting of $MoO_3$-crystals embedded in amorphous $SiO_2$ had formed after 72, and 210 hours, respectively, at 450° C. The quantity ratio between these two oxides appeared to be constant.

Much larger $MoO_3$-crystals were formed after 72 and 210 hours, respectively, in an oxygen gas atmosphere that contained 10 percent by volume water. The proportion of $SiO_2$ in relation to the proportion of $MoO_3$ also appeared to decrease with time.

The water content of the surrounding atmosphere thus influenced the structure and the quantity ratio of the oxides formed. The structure and quantity ratio of the formed oxides is a probable explanation of the large differences in oxide growth, as discussed above, in relation to the water content of the surrounding gas.

It can also be noticed that the amount of oxygen in the surrounding atmosphere has no significant influence on the oxide growth.

As mentioned in the introduction, the aforesaid elements are used at said temperatures in certain industrial processes.

As mentioned earlier, the present invention involves causing the water content of the surrounding atmosphere to lie below about one percent by volume. FIG. 2 shows that the oxide growth is therewith only slightly greater than in the case of a completely dry atmosphere.

However, it is preferred to bring the water content to a level that is less than about 0.5 percent by volume.

According to one preferred embodiment of the invention, the atmosphere surrounding the elements is comprised of air that has the aforesaid water content. Air of this dryness can be produced with the aid of commercially available plant and apparatus. Dry air is also available in air cylinders.

According to another preferred embodiment, the atmosphere is comprised of oxygen gas that has the aforesaid water content. Bottled dry oxygen gas can be used to this end.

The atmosphere chosen will depend on the process in which the heating elements are used.

Atmospheres other than air and oxygen gas will probably give a corresponding result with respect to the formation of oxides, provided that the atmosphere has a water content according to the invention. For example, it is likely that nitrogen gas or an inert gas can be used.

The present invention shall not therefore be considered to be limited to the aforesaid atmospheres surrounding the elements.

What is claimed is:

1. A method of lengthening the useful life of heating elements that are formed from molybdenum silicide and molybdenum tungsten silicide and alloys of those materials, which elements lack a layer of silicon dioxide, said method comprising the steps of: operating the heating elements at an element temperature in the range of from about 400° C. to about 800° C.; and surrounding the elements as they operate with a gaseous atmosphere having a water content that is less than about 0.5 percent by volume.

2. A method according to claim 1, wherein the gaseous atmosphere is air that has a water content of less than about 0.5 percent by volume.

3. A method according to claim 1, wherein the gaseous atmosphere is oxygen gas that has a water content of less than about 0.5 percent by volume.

* * * * *